United States Patent [19]

Ullum

[11] Patent Number: 4,982,514

[45] Date of Patent: Jan. 8, 1991

[54] APPARATUS FOR HEATING AND/OR DRYING

[76] Inventor: Henrik Ullum, Lykkesholm 1, DK-2690 Karlslunde, Denmark

[21] Appl. No.: 382,683

[22] PCT Filed: Dec. 28, 1987

[86] PCT No.: PCT/DK87/00163

§ 371 Date: Aug. 11, 1989

§ 102(e) Date: Aug. 11, 1989

[87] PCT Pub. No.: WO89/06337

PCT Pub. Date: Jul. 13, 1989

[51] Int. Cl.[5] ..... F26B 11/12

[52] U.S. Cl. ..... 34/183; 34/179; 165/86

[58] Field of Search ..... 34/179, 183, 124, 166, 34/182; 165/86

[56] References Cited

U.S. PATENT DOCUMENTS 3,923,097 12/1975 Hovad ..... 34/179

4,640,345 2/1987 Nishimura ..... 165/86

*Primary Examiner*—Henry A. Bennet

*Attorney, Agent, or Firm*—Antonelli, Terry, Stout & Kraus

[57] ABSTRACT

An apparatus for the heating and/or drying of wet, comminuted material, e.g. organic material, comprises a stationary housing (2) with a rotatable, hollow rotor (3) with inlet (4) and discharge (5) of a heating medium and possible condensate (6) thereof, and where the rotor has annular drying elements (9) disposed at intervals and with annular channels (10) to which the heating medium is fed in a parallel maner from a central channel (11). The annular channels (10) are circular and are disposed concentrically with each other and with the rotor (3).

15 Claims, 4 Drawing Sheets

APPARATUS FOR HEATING AND/OR DRYING

BACKGROUND OF THE INVENTION

The present invention relates to an apparatus for heating and/or drying of wet, comminuted material such as, for example, organic material.

A heating and/or drying apparatus of the aforementioned type generally include a rotatable hollow rotor with an inlet and discharge reheat medium and possible condensate, with the rotor having annular polygonal drying elements disposed at intervals and hollow channels for the heat medium disposed in an annular manner.

Apparatus of the aforementioned type have been employed for the treatment of wet materials such as fishmeal, comminuted offal, mash from breweries and similar moist, glutinous materials of animal or vegetable origin and are usually designed for high performance such as, for example, the drying of several tons of material at a time.

In, for example, Danish Patent No. 138,406, an apparatus of the aforementioned type is proposed wherein the annular channels with hollow spaces for the heating medium in each drying element are in the form of a spiral for the through-flow of steam. The channels are spiral shaped so as to more easily drive the condensate out of the channels thereby achieving a good and continuous through-flow of steam.

A disadvantage of the utilization of spiral-shaped channels resides in the fact that the production costs and procedures are considerable since, in practice, the spiral shape is produced by a composition of circular sectors of suitably curved bands of plate material, with the plate material being welded onto the disk-shaped rotors through difficult welding processes. Moreover, the ends of the curved bands must also be welded together, pressure tight and generally executed in stainless materials.

The aim underlying the present invention essentially resides in providing an apparatus of the aforementioned type which is constructed in such a manner that production, to a great extent, is facilitated without giving rise to other disadvantages.

In accordance with advantageous feature of the present invention, an apparatus for heating and/or drying of wet comminuted material is provided having at least two annular channels to which the heating medium is fed in parallel, with annular drying elements being provided each of which comprise two plates coupled together to one drying element. At least one of the plates is deformed in such a manner that the channels are formed and the two plates are joined directly together by welding.

The object of the invention is to provide an apparatus of the kind in question, but of such a configuration that the production is to a great extent made easier without hereby giving rise to other disadvantages.

By virtue of the above noted features of the present invention, it is possible to feed several channels in parallel at one time, which gives a more uniform distribution of heat in the drying element and the possibility for the supply of more thermal energy than with the known constructions. In practice, no problems arise with possible condensate if the heating is effected by steam. The heating can, however, also be carried out with, for example hot oil or the like. The supply of large amounts of thermal energy is of great importance if, for example, the comminuted material shall be boiled and possibly sterilized as quickly as possible.

With the new configuration of the apparatus, positioning of the annular channels, since the annular channels be placed in any position over the whole of the drying elements, i.e. in a one-sided or two-sided formation and closely at the side of each other, or with a distance between them. In accordance with still further features of the present invention, the annular channels are configuration on both sides of the drying elements so that a very great supply of thermal energy can be achieved together with a uniform heating of the whole of the drying element.

The plates may, in accordance with the present invention, be roundels, with both roundels in each drying element being deformed for the formation of the channels. With such an arrangement, the production is simplified since the welding of the channel parts is avoided and the drying elements are produced by providing a plate with suitable deformation so that the desired channel pattern arises.

While the plates are preferably roundels, and it can be sufficient for one roundel in each pair to be deformed for the formation of channels, however, according to the invention, the two annular channels do not necessarily have the same cross-sectional area, whereby the possibility is provided for channels of greater cross-sectional area and thus a greater supply of thermal energy, hereby increasing the capacity of the apparatus. This channel configuration also offers advantages from the point of view of production technology.

Since the annular channels in each drying element are not, in fact, of equal length, they do not have the same resistance to flow. In order to achieve a uniform temperature distribution across each drying element, the channels may have a greater cross-sectional area the greater the distance from the channels and/or the annular channels may be disposed in a circular manner on the drying element.

In accordance with yet further features of the present invention, the circular channels are advantageously concentric with respect to each other, whereby, the whole of the welding operation involved in welding the channels onto the drying elements can be automated and carried out by simple welding robots, and a very even and uniform weld seam requiring the minimum of aftertreatment is achieved.

The circular channels may also, in accordance with the present invention be concentric with the drying element and the rotor and/or an outer edge of the annular drying elements may be of a polygonal configuration, whereby, the possibility is provided for a large number of channels on each drying element, and herewith a great supply of thermal energy.

According to the present invention, the annular channels may be of a polygonal configuration corresponding to the outer edge of the annular drying element and/or the outer edge of the drying element may be a quadratic, whereby changes can be made in the pattern of the stirring and the heat distribution, e.g. depending on what kind of materials are to be handled. In accordance with additional features of the present invention, a supply channel for the heating medium may be disposed on one side of the heating element with a return channel for the heating medium being disposed on the other side of the drying element. By virtue of this arrangement, an optimum utilization of raw materials is realized in that the drying elements can be produced by the shearing of lengths of material which are then worked up in the formation of channels, etc. with the heating medium supplied on the one side of the drying element and the return flow on the other side according to the present invention the channels can be executed in an almost completely annular manner. Thereby resulting in a very uniform heat distribution, and it is avoided that the supply channel and the return channel lie in each other's way during the welding operation. With some embodiments of the drying element, it can be advantageous that both the supply channel and the return channel are positioned on the same side, for example on the same side as the channels.

BRIEF DESCRIPTION OF THE DRAWINGS

The invention will now be described in more detail with reference to the accompanying drawing, in that FIG. 1 is a schematic longitudinal section of a prior art apparatus.

DETAILED DESCRIPTION

Figure 1:
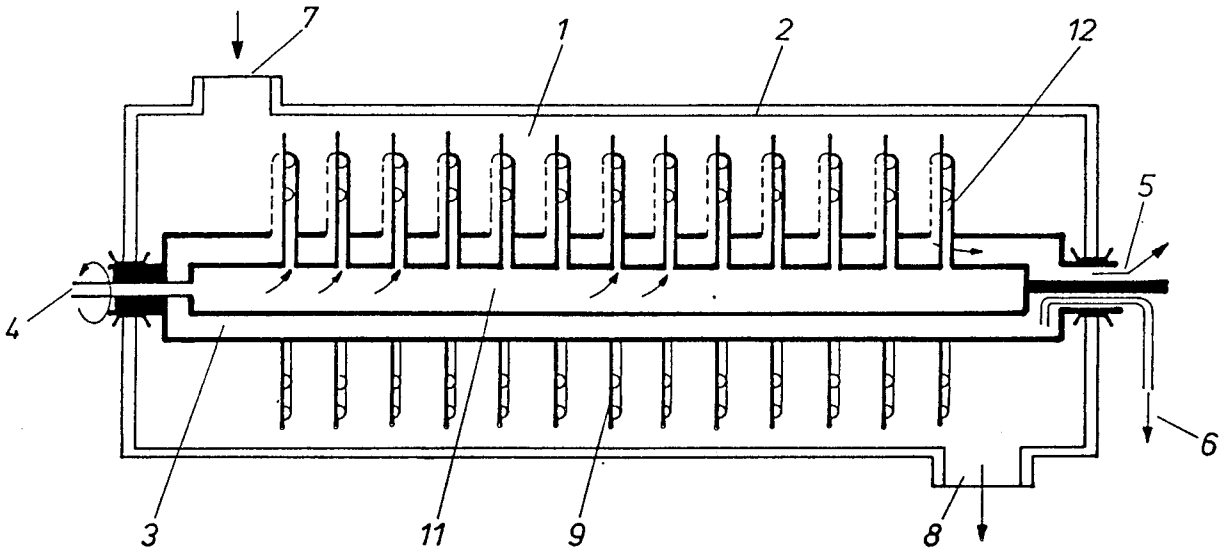
FIG. 1 PRIOR ART

The apparatus 1 shown schematically in FIG. 1 comprises a stationary housing 2, possibly provided with a heat shroud, a filling opening 7 for the material to be dried, and a discharge opening 8 for the finish-dried material. The material introduced is dried by a heated, rotating rotor 3 with circular, plane drying elements 9 disposed at intervals. For the sake of clarity, the expression drying elements will be used when referring to the part 9, although for different applications it heats the material more or less.

When new, wet material is continuously introduced into the apparatus 1, the material to be heated or boiled will migrate towards the discharge opening 8. The stationary housing 2 has discharge openings (not shown) for the steam which is given off by the wet material during the drying.

The rotor 3 has a supply pipe 4 for the heating medium, e g. steam, leading to a central pipe 11, and a discharge pipe 5 for steam plus a second discharge pipe 6 for condensate. The mode of operation is, in fact, the same as described in, for example, Danish Patent No. 138.406.

Figure 2:
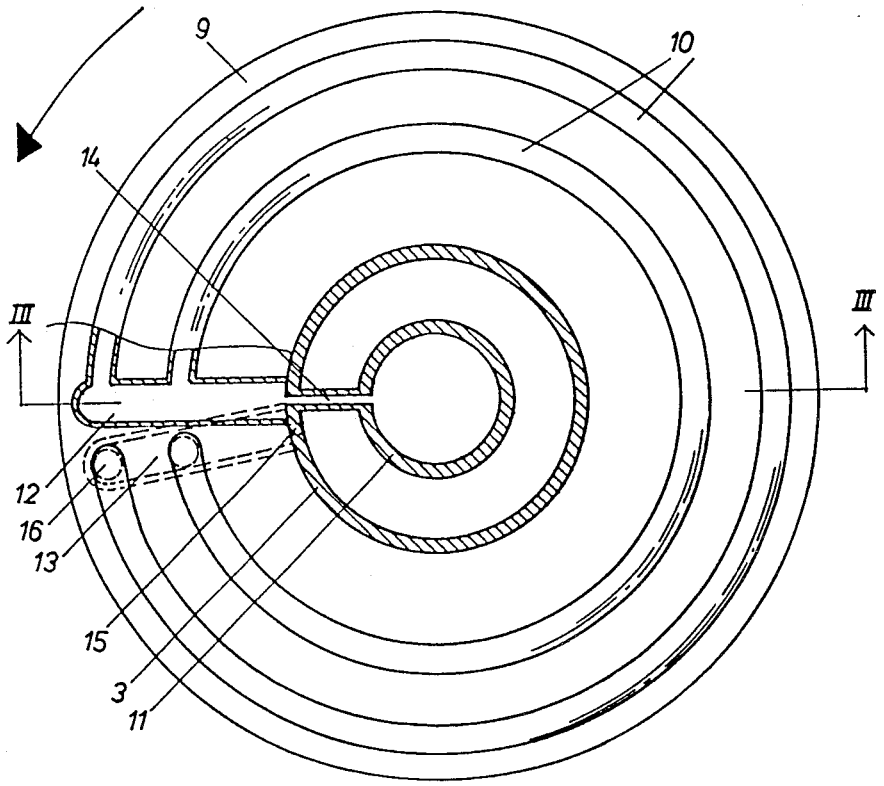
FIG. 2 PRIOR ART
FIG. 2 is a plan view of a drying element of the apparatus of FIG. 1.
Figure 3:
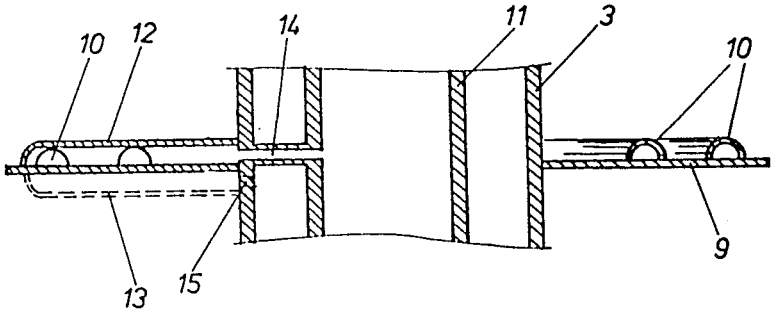
FIG. 3 PRIOR ART
FIG. 3 is a radial section of the drying element in FIG. 2 seen in the direction III—III.

In FIGS. 2 and 3 is seen a drying element 9 on a larger scale and with two circular and concentric channels 10 which are concentric with the rotor 3, produced by arched, circular strips of stainless steel being welded to the drying element 9 which is a circular, plane disc, also of stainless steel.

The channels 10 are fed in parallel via a supply channel 12, which via a supply pipe 14 is connected to the central pipe 11. When the heating medium has passed around through the channels 10, it passes through holes 16 in the drying element 9 to a return channel 13 on the other side of the drying element, and via a return pipe 15 to the rotor 3.

The channels 10 can have identical through-flow clearance, or be configured with different clearance and hereby regulate the through-flow resistance as desired. The through-flow resistance can also be regulated bY inserting means such as throttle elements or the like. It is hereby ensured that the flow of heating medium through the channels 10 is as desired e.g. uniform through-flow in all the channels.

In the example in FIGS. 2 and 3, the channels 10 are shown one-sided on the one side of the drying element 9. It will be obvious that the channels can also be disposed on both sides of the drying element 9, either opposite one another or staggered from one another. The channels can be disposed at intervals from one another or closely up against one another, all depending on how uniform the temperature distribution is desired to be and on how great a supply of heat is required.

Figure 4:
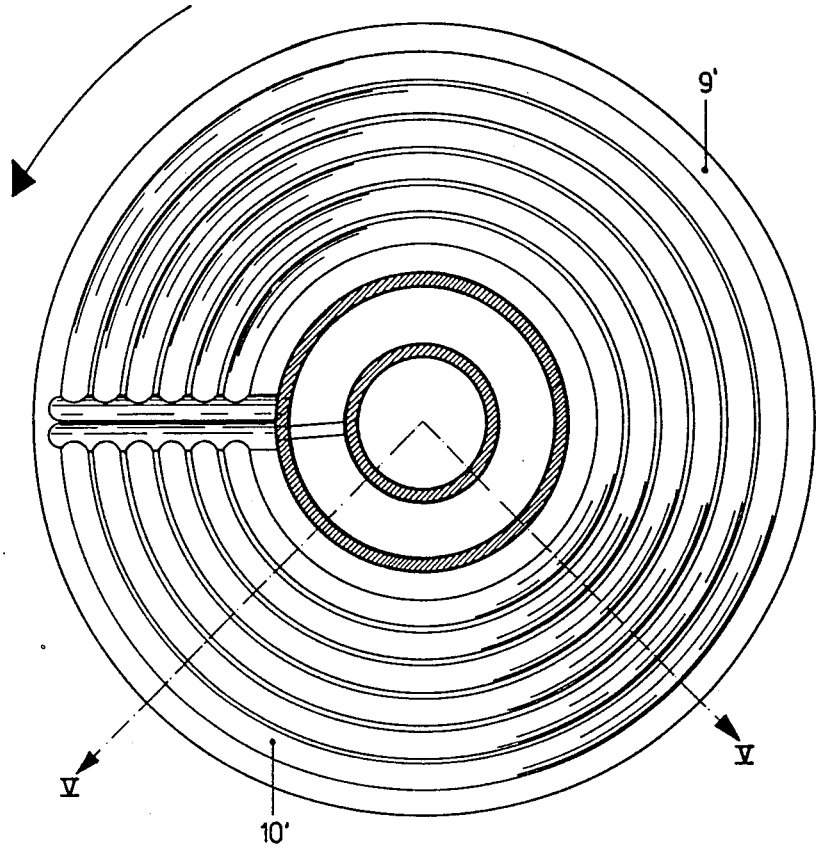
FIG. 4 is a plan view of a drying element according to the invention.
Figure 5:
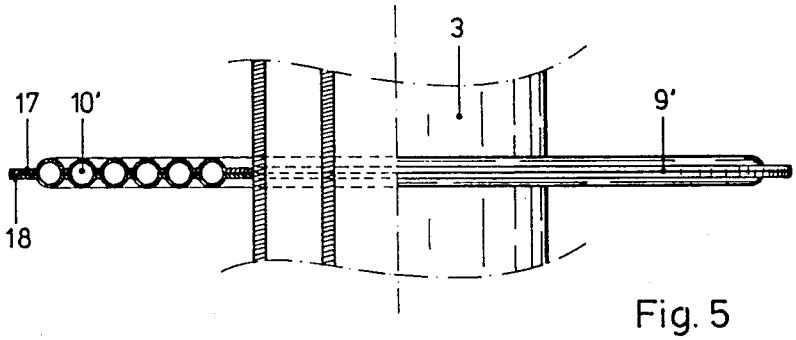
FIG. 5 is partly a radial section of the drying element in FIG. 4 seen in the direction V—V.

FIGS. 4 and 5 show an example of an embodiment of the drying element 9, of the present invention in that two roundels 17, 18 are suitably deformed and joined together, e.g. by welding. In the shown example, both roundels are deformed, but in practice it is sufficient for only one of the roundels to be deformed while the other is plane. In the shown example, the channels 10' are disposed immediately up against each other over the whole of the drying element 10', but naturally they can also be distributed with distance between them as shown in FIG. 2.

Figure 6:
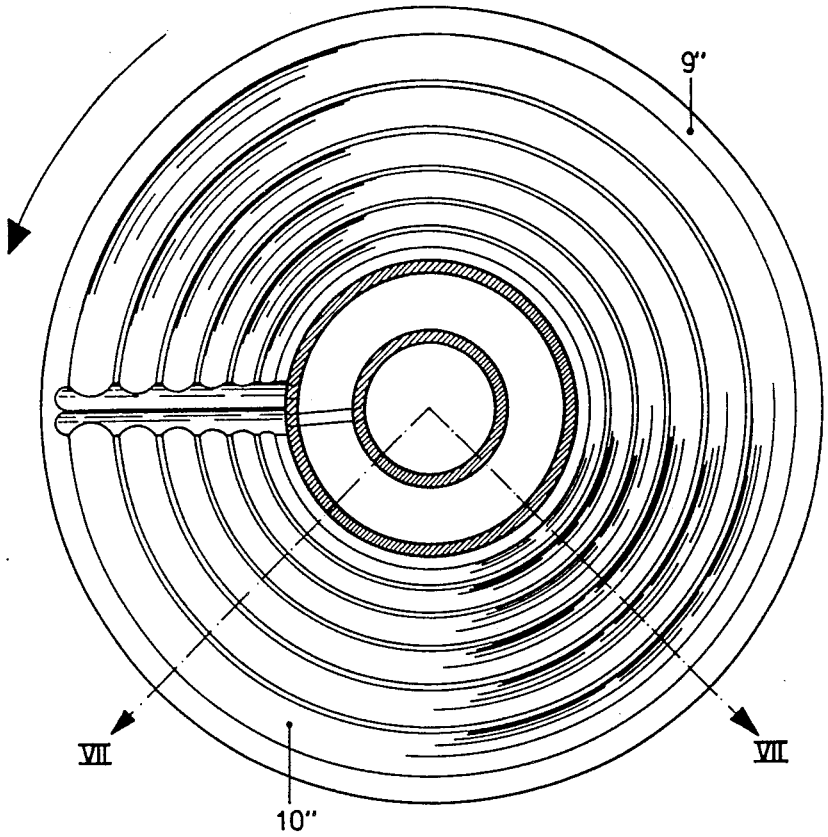
FIG. 6 is a plan view of a drying element according to another embodiment of the invention.
Figure 7:
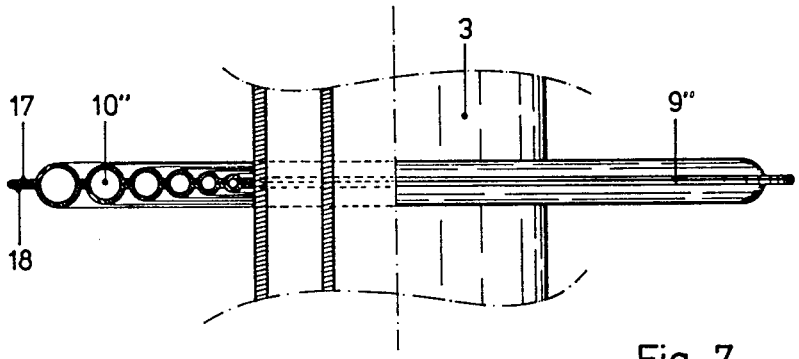
FIG. 7 is partly a radial section of the drying element in FIG. 6 seen in the direction VII—VII.

In FIGS. 6 and 7 is shown a special embodiment of the drying element shown in FIGS. 4 and 5, in that the roundels 17 and 18 are provided with special channels 10'', so that the drying element 9'' is given an even heat distribution, in that the innermost channels have less clearance than the outermost, e.g. evenly decreasing as shown, whereby the shorter the channels, the greater becomes the through-flow resistance.

In FIGS. 4–7 the supply means and the return means, e.g. pipelines, for the heating medium and possible condensate, are merely outlined. It will be obvious to those familiar with the art that supply pipes and discharge pipes for the channels 10' and 10'' can be executed in many other ways than those outlined.

All of the shown channels 10, 10', 10'' are shown with circular cross-sectional profile, but it will be obvious to those familiar with the art that innumerable other cross-sectional profiles can be used and produced with the same effect as the above-described, and without deviating from the basic spirit of the invention.

In the examples in the drawing, all of the drying elements 9, 9', 9'' are shown with a circular peripheral edge, and all channels 10, 10', 10'' are similarly shown circular. It will be obvious to those familiar with the art that these parts can also have other geometric forms. For example, the drying element can be polygonal, possibly with a quadratic outer edge, and have circular channels or channels which follow the geometry of the edge. Nor is there anything to prevent a circular drying element from having channels with another geometry, for example polygonal.

I claim:

1. Apparatus for heating and/or drying of wet, comminuted material, said apparatus comprising a stationary housing rotatably accommodating a hollow rotor having an inlet means and discharge means for a heat medium, annular drying elements disposed at intervals along said hollow rotor, and at least two hollow annular channels provided in the annular drying elements to which the heating medium is fed in parallel, wherein each of the annular drying elements comprise two substantially planar plates directly welded to each other so as to be coupled together and to form one drying element, and wherein at least one of the two substantially planar plates is deformed so as to form said at least two annular channels directly in said at least one substantially planar plate.

2. Apparatus according to claim 1, wherein the at least two annular channels are configured on both sides of the respective annular drying elements.

3. Apparatus according to claim 2, wherein the two substantially planar plates are roundels, and wherein both roundels in each annular drying element are deformed so as to form said at least two annular channels.

4. Apparatus according to any one of claims 1–3, wherein the at least two annular channels have a different cross-sectional area.

5. Apparatus according to claim 4, wherein the cross-sectional area of the respective annular channels increases as a distance of the respective annular channels from the hollow rotor increases.

6. Apparatus according to one of claims 1 3, wherein the at least two annular channels are disposed in a circular manner on the respective drying elements.

7. Apparatus according to claim 6, wherein the at least two annular channels are concentric with respect to each other.

8. Apparatus according to claim 7, wherein the at least two annular channels are concentric with respect to the annular drying elements and the hollow rotor.

9. Apparatus according to one of claims 1 or 2, wherein an outer edge of the annular drying elements is of a polygonal configuration.

10. Apparatus according to claim 9, wherein the at least two annular channels are of a polygonal configuration.

11. Apparatus according to claim 9, wherein the outer edge of the annular drying element is quadratic.

12. Apparatus according to claim 1 or 2, characterized in that a supply channel (12) for the heating medium is disposed on the one side of the heating element, and that a return channel (13) for the heating medium is disposed on the other side of the drying element.

13. An apparatus according to claim 9, wherein the at least two channels are of a polygonal configuration corresponding to the polygonal configuration of the outer edge of the annular drying elements.

14. Apparatus according to claim 1, wherein the wet comminuted material is an organic material.

15. Apparatus according to claim 13, wherein the hollow rotor includes a condensate discharge pipe means.

* * * * *